United States Patent [19]

Endo

[11] Patent Number: 4,914,480

[45] Date of Patent: Apr. 3, 1990

[54] CORONA DISCHARGING DEVICE FOR AN ELECTROPHOTOGRAPHIC APPARATUS

[75] Inventor: Hidenobu Endo, Tokyo, Japan

[73] Assignee: Ricoh Company, Ltd., Tokyo, Japan

[21] Appl. No.: 244,671

[22] Filed: Sep. 15, 1988

[30] Foreign Application Priority Data

Sep. 16, 1987 [JP] Japan ..... 62-140027

[51] Int. Cl.[4] ..... G03G 15/02

[52] U.S. Cl. ..... 355/221; 355/219

[58] Field of Search ..... 355/219, 221, 222, 223, 355/224, 225, 226, 227; 354/3; 250/324, 325, 326; 361/225, 212, 214

[56] References Cited

FOREIGN PATENT DOCUMENTS 0199358 11/1983 Japan ..... 355/219

0209562 9/1987 Japan ..... 355/219

*Primary Examiner*—A. T. Grimley

*Assistant Examiner*—Nestor R. Ramirez

*Attorney, Agent, or Firm*—Oblon, Spivak, McClelland, Maier & Neustadt

[57] ABSTRACT

A corona discharging device of the type using a wire and for use with an electrophotographic copier or similar apparatus which effects an electrostatic process. Any of end blocks which are located at opposite ends of a shield case and made of an insulating material accommodates therein a conductive member in the form of a spring which is connected to a corona wire. A generally hollow cylindrical end block cover is made of an insulating material and configured to surround at least that part of the end block in which the spring is disposed. The end block cover is slid on and along the outer periphery of the end block along the axis of the cover into and out of engagement with the end block. The device may serve as a charger for charging a photoconductive element, a discharger for discharging it, or a precleaning discharger of a cleaning unit.

5 Claims, 5 Drawing Sheets

CORONA DISCHARGING DEVICE FOR AN ELECTROPHOTOGRAPHIC APPARATUS

BACKGROUND OF THE INVENTION

The present invention relates to a corona discharger of the type using a wire and applicable to an electrophotographic copier or similar apparatus which effects an electrostatic process so as to serve as a charger for charging a photoconductive element, a discharger for discharging it, or a precleaning discharger of a cleaning unit.

A corona discharging device of the type described is extensively used with an electrophotographic copier which performs an electrostatic process for the purpose of charging or discharging the surface of a photoconductive element. A prior art corona discharging device of this type is generally made up of a gutter-like shield case, end blocks provided at opposite sides of the end block and made of an insulating material, and a corona wire connected to a feed terminal by a spring which is disposed in one of the end blocks and extending between the end blocks. When a high voltage is applied from the feed terminal to the corona wire via the spring, corona discharge occurs between the wire and the shield case to charge or discharge a photoconductive element which is located in the vicinity of an opening of the shield case.

A problem with a corona discharging device of the type described is the leak of current which occurs at the end blocks. Specifically, the leak occurs between the spring or the corona wire which is disposed in each end block and a grounding member adapted to ground the shield case, sometimes over the space between the spring or the corona wire and the grounding member and sometimes along the surface of the end block. The leak over the space and the lead along the end block surface will hereinafter be referred to as spatial leak and creeping leak, respectively. The leak disturbs corona discharge and thereby the quality of a reproduction. In addition, a control circuit is apt to malfunction due to electrical noise which is ascribable to leak current. Implementations customarily adopted against the leak are as follows:

(1) increasing the distance between the spring in the end block and the grounding member;

(2) forming undulation on the surface of the end block to increase the creeping distance between the spring and the grounding member; and (3) disposing a screening member made of an insulating material between the spring and the grounding member.

The approach (1) stated above is allowable if an apparatus in which the corona discharging device is incorporated has a relatively large size. When the size of such an apparatus is relatively small, the approach (2) or (3) is adopted because a sufficient distance is not available between the spring and the grounding member. Especially, the screening member in accordance with the approach (3) is effective when constituted by a cover which closes the opening of the end block. This is because the end block is necessarily provided with an opening for laying and replacing the corona wire. However, since the prior art end block cover closes the opening of the end block from one side only, gaps are not avoidable between the interengaging surfaces of the end block and cover although they may be invisible, however accurate the fininishing of those members may be. It follows that the spatial distance or the creeping distance between the grounding member and the spring disposed in the end block cannot be increased beyond a certain limit. Further, it is difficult to provide undulation on the end block due to the current trend toward the miniaturization of apparatuses of interest.

SUMMARY OF THE INVENTION

It is therefore an object of the present invention to eliminate the leak of current at end blocks of a corona discharging device.

It is another object of the present invention to provide a simple, safe and reliable corona discharging device which prevents the leak of current from occurring between a spring or similar conductive member or a corona wire disposed in an end block and a conductive grounding member.

It is another object of the present invention to provide a generally improved corona discharging device for an electrophotographic apparatus.

A corona discharging device of the present invention comprises a shield case, end blocks made of an insulating material and each being located at a respective one of opposite ends of the shield case while accommodating a conductive member, a corona wire connected to a feed terminal by the conductive member which is accommodated in one of the end blocks and extending between the end blocks, and a generally hollow cylindrical end block cover made of an insulating meterial and surrounding at least that part of any of the end blocks in which the conductive member is provided. The end block cover is slid on and along outer periphery of the end block in an axial direction of the end block cover into and out of engagement with the end block.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
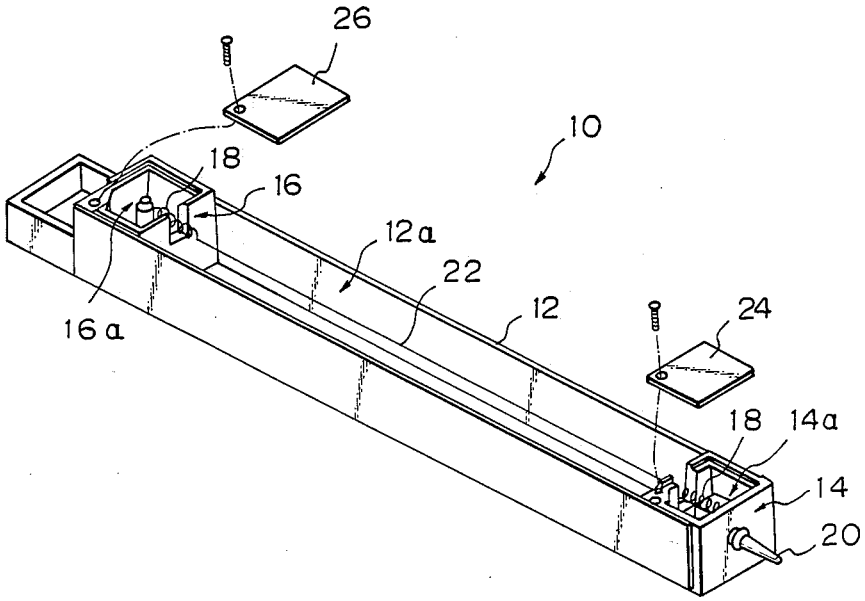
Fig. 1 PRIOR ART
FIG. 1 is a perspective view exemplarily showing a prior art corona discharging device.

To better understand the present invention, a brief reference will be made to a prior art corona discharging device of the type using a wire, shown in FIG. 1. As shown, the prior art device, generally 10, includes a gutter-like shield case 12 and end blocks 14 and 16 which are individually located at opposite ends of the shield case 12. The end blocks 14 and 16 are made of an insulating material. A spring 18 is disposed in the end block 14 to serve as a conductive member. A corona wire 22 is stretched between the end blocks 14 and 16 and connected to a feed terminal 20 via the spring 18. When a high voltage is applied from the feed terminal 20 to the corona wire 22 via the spring 18, corona discharge is caused between the wire 22 and the shield case 12 to discharge or charge, for example, a photoconductive element of an electrophotographic copier which is positioned in the vicinity of an opening 12*a* of the shield case 12. In the prior art device 10 having such a construction, the leak of current is apt to occur at each of the end blocks 14 and 16. i.e., between the conductive member (spring) 18 or corona wire 22 and a conductive member adapted to ground the shield case 12. In the light of this, covers 24 and 26 are provided for covering respectively openings 14*a* and 16*a* which are formed in the end blocks 14 and 16. However, since the covers 24 and 26 simply close the openings of the end blocks 14 and 16 from one side only, gaps are necessarily left between the interengaging surfaces of the end blocks 14 and 16 and covers 24 and 26 although they may be invisible, however accurate the finishing of such members may be. The covers 24 and 26, therefore, cannot effectively eliminate the leak.

Figure 2:
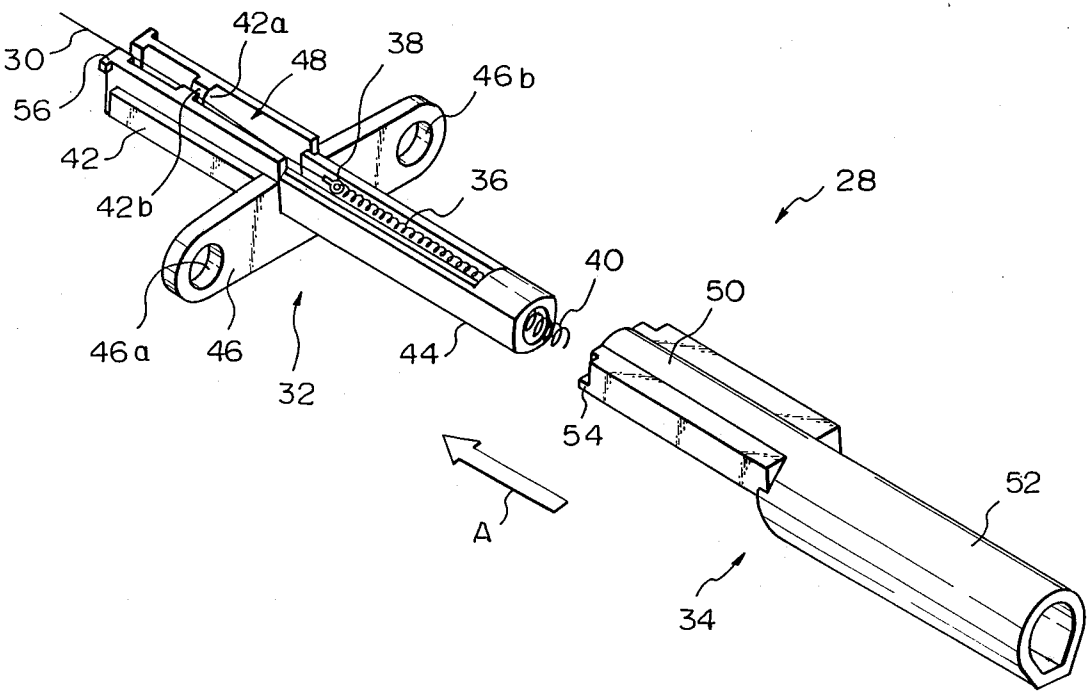
FIG. 2 is a perspective view showing in a separated condition an end block and an end block cover which in combination constitute a corona discharging device embodying the present invention.
Figure 3:
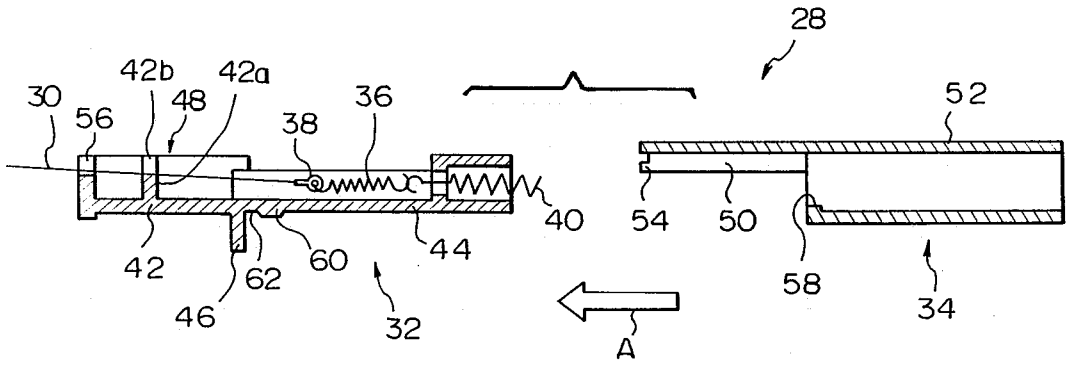
FIG. 3 is a sectional side elevation also showing the end block and end block cover of the illustrative embodiment in a separated condition.
Figure 4:
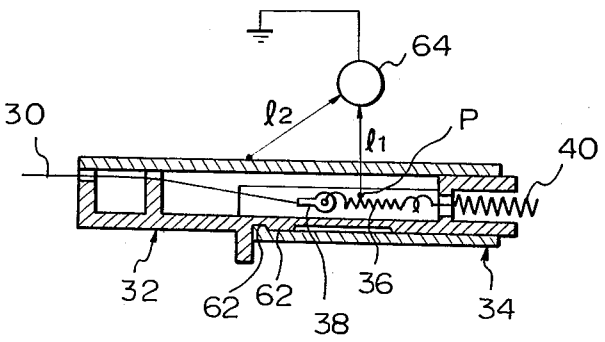
FIG. 4 is a sectional side elevation showing the end block and end block cover in an assembled condition and useful for understanding the operation of the device.

Referring to FIGS. 2 to 4, a corona discharging device embodying the present invention is shown and generally designated by the reference numeral 28. More specifically, there are shown one end block 32 which is located at that side where a corona wire 30 is connected to a feed terminal (not shown), an an end block cover 34 adapted to enclose the end block 32. The corona wire 30 is implemented by a tungsten wire having a diameter of several tens of microns. A tension spring 36 is anchored to one end of the corona wire 30 by a hook 38 so as to hold the wire 30 under tension. The tension spring 36 is connected to the feed terminal via a receiving spring 40 which is implemented by a compression spring and fixed at the end thereof which is adjacent to the spring 36. The end block 32 is made up of a positioning member 42 for positioning the corona wire 22, a tension member 44 for applying tension to the wire 22 and receiving a voltage, and a bracket 46 for securely connecting the end block 32 to a rigid member of the framework of an apparatus such as an electrophotographic copier. A partition 42*a* is provided in the positioning member 42 to extend in a direction perpendicular to the lengthwise direction of the end block 32. The free end of the partition 42*a* is notched in a generally V shape as designated by the reference numeral 42*b*. When the wire 22 is stretched in an operative position, it is pressed against the bottom of "V" of the notch 42*b* to be thereby positioned in the up-down and right-left directions. Extending sideways from opposite sides of the end block 32, the bracket 46 is formed with a circular hole 46*a* at one end of an elongate slot 46*b* at the other end so that it may be fastened to a shield case 66 (see FIG. 5) by screws.

The end block cover 34 is made of synthetic resin and includes a tongue 50 which covers an opening 48 of the positioning member 42 and a generally hollow cylindrical member 52 which encloses the entire tension member 44. Lugs 54 extend from opposite sides of the free end (right side as viewed in the figures) of the tongue 50 at a level slightly lower than the top of the tongue 50. Lugs 56 extend sideways from opposite sides of an upper portion of that end of the end block 32 which is adjacent to the shield case 66, each of the lugs 56 being associated with a respective one of the lugs 54. A protuberance 58 is provided on the inner surface of a lower portion of the left end of the cylindrical member 52 as viewed in FIG. 3 to extend slightly inward in the radial direction. Further, a protuberance 58 is provided on the underside of a left end portion of the tension member 44 in association with the protuberance 58 and is tapered at opposite ends with respect to the lengthwise direction of the end block 32. A recess 62 is defined between the left tapered portion of the protuberance 58 as viewed in FIG. 3 and the bracket 46.

In assembly, the corona wire 30 is connected to the receiving spring 40 via the hook 38 and tension spring 36 and thereby fixed in place in the end block 32. Then, the end block cover 34 is coupled over the end block 32 in a sliding motion as indicated by an arrow A in FIGS. 2 and 3. As the cover 34 fully covers the end block 34, the lugs 54 of the cover 34 are slid under their associated lugs 56 of the end block 32 with the result that the cover 34 is prevented from rising by the lugs 56. In this condition, the interengaging surfaces of the tongue 50 and positioning member 42 are held in close contact without any gap being developed therebetween. As shown in FIG. 4, the protuberance 58 provided at the left end of the cylindrical member 52 of the cover 52 is received in the recess 62 of the end block 32 to prevent the cylindrical member 52 and the end block 32 from slipping out from each other. Since such interengagement of the protuberance 58 and recess 62 simply owes to the resiliency of synthetic resin of which the cover 34 is made, the cover 34 can be easily removed from the end block 32 by pulling the cover 34 lightly away from the block 32. In this case, the axial direction of the cover 34 should preferably be aligned with the direction in which the corona wire 30 extends so as to facilitate such an operation.

Now, the spatial distance between a grounding member 64 and a point P of the conductive member in the form of a spring 36 which is closest to the grounding member 64 will be considered with reference to FIG. 4. In the prior art device 10 shown in FIG. 1, the spatial distance is almost the same as the distance in a straight line $l_1$ because the covers 24 and 26 are provided only in the openings 14*a* an 14*b* of the end blocks 14 and 16. On the other hand, in the illustrative embodiment of the present invention, since the cover 34 constituted by the cylindrical member 52 encloses that portion of the end block 32 which accommodates the conductive member (spring) 36, there is no gap around the cylindrical member 52 of the cover 34 available for a current to flow. Hence, the spatial distance or the creeping distance between the grounding member 64 and the point P of the conductive member (spring) 36 in the end block 32 is $l_2$ which is the length of the bent path which extends via the left end of the cylindrical member 52, whereby leak is eliminated. It may occur that the spatial distance or the creeping distance attainable with the illustrative embodiment is the same as that of the prior art depending upon the position of the grounding member 64, because the left portion of the cover 34 covers the end block 32 from the above as is the case with the prior art. It will therefore be necessary to give consideration to the design of the cover 34 depending upon the position of the grounding member 64.

Figure 5:
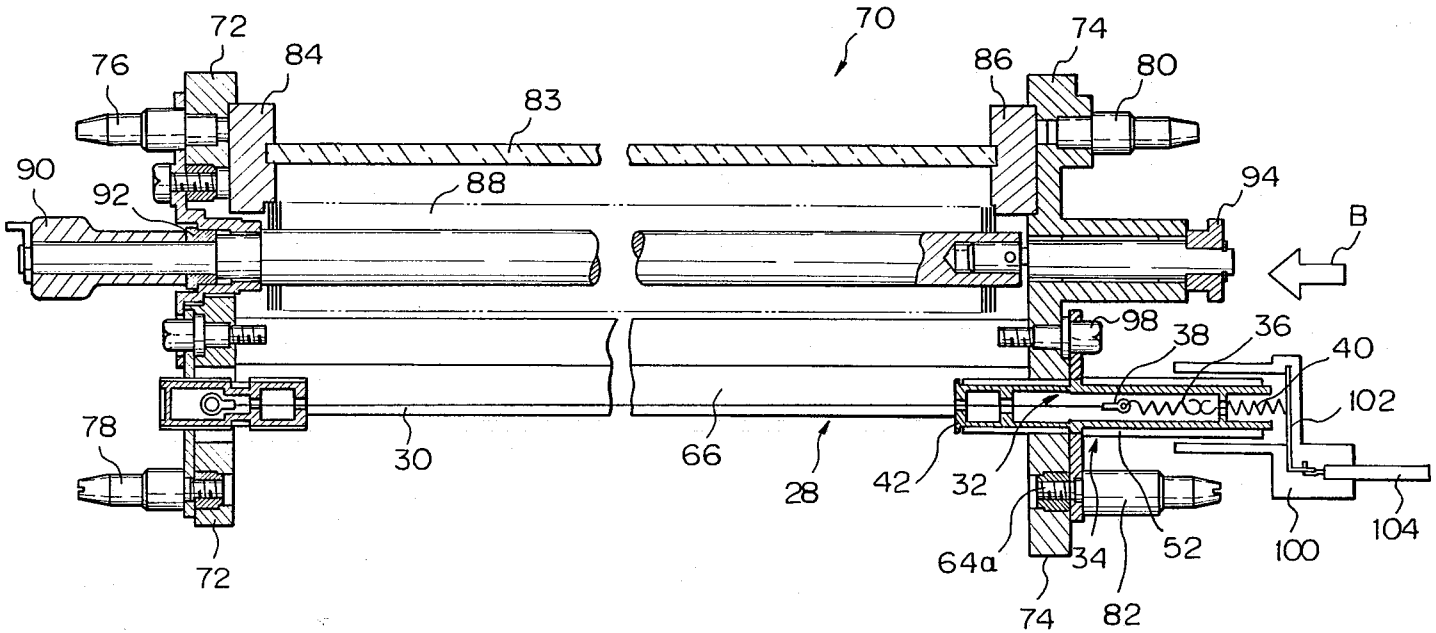
FIG. 5 is a sectional side elevation exemplarily showing a precleaning discharger of a cleaning unit of an electrophotographic apparatus which is implemented by the embodiment of FIGS. 2 to 4.
Figure 6:
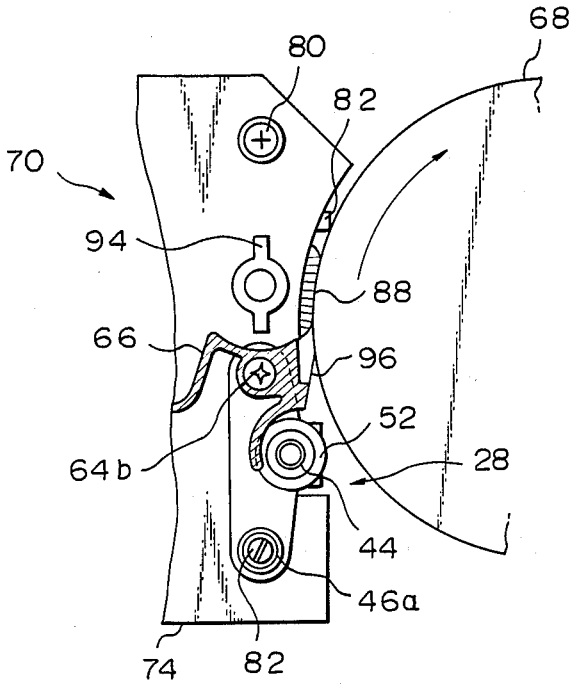
FIG. 6 is a view seen in a direction indicted by an arrow B in FIG. 5.

Referring to FIGS. 5 and 6, a cleaning unit of an electrophotographic copier is shown to which the corona discharging device 28 in accordance with the present invention is applied. In this exemplary application, the device 28 serves as a precleaning discharger which adjusts the potential of toner remaining of a photoconductive element for promoting easy cleaning.

As shown in FIGS. 5 and 6, a cleaning unit 70 with the corona discharging device 28 is located in the vicinity of a photoconductive element 68. The cleaning unit 70 includes a front panel 72 and a rear panel 74 which are securely connected to the framework of the copier by positioning pins 76 and 78 and positioning pins 80 and 82, respectively. A cleaning blade 83 is supported by the front and rear panels 72 and 74 in such a manner as to contact the photoconductive element 68. Seal members 84 and 86 are provided at opposite ends of the cleaning blade 83 and in the vicinity of the front and rear panels 72 and 74, respectively. The seal members 84 and 86 are adapted to seal the opposite ends of the cleaning blade 83. A fur brush 88 is also supported by the opposite panels 72 and 74. A drive gear 90 for driving the fur brush 88 and a bearing 92 are mounted on the front panel 72 while a coupling 94 for driving the fur brush 88 is mounted on the rear panel 74. In FIG. 6, the reference numeral 96 designates an inlet seal.

The device 28 is also supported by the front and rear side panels 72 and 74. As shown in FIGS. 5 and 6, the end block of the device 28 which is supported by the front panel 72 is implemented by the prior art construction of FIG. 1 while the end block which is supported by the rear panel 74 is implemented as the embodiment of FIGS. 2 to 4. Specifically, the end block 32 of the device 28 is enclosed by the cover 34, and the bracket 46 is positioned relative to the rear panel 74 by a positioning pin 98 and the previously mentioned positioning pin 82. As shown in FIG. 5, the cover 34 is loaded with a receptacle 100 for feeding a high voltage to the corona wire 30. A terminal in the form of a sheet metal 102 is embedded in the receptacle 100. The terminal 102 is held in contact with the spring 40 of the end block 32 at one end and connected to a high tension cord 104 at the other end.

In summary, in accordance with the present invention, unprecedented spatial and creeping distances are available between a grounding member and a conductive member of a corona discharging device without increasing the dimensions of an end block, enhancing safety operation of the device. Stated another way, a smaller end block and therefore a smaller corona discharging device suffices for the same spatial and creeping distances as the prior art. This contributes a great deal to the reduction in the space required of an apparatus to which the device is applied.

Various modifications will become possible for those skilled in the art after receiving the teachings of the present disclosure without departing from the scope thereof.

What is claimed is:

1. A corona discharging device comprising:

a shield case;

end blocks made of an insulating material and each being located at a respective one of opposite ends of said shield case while accommodating a conductive member;

a corona wire connected to a feed terminal by the conductive member which is accommodated in one of said end blocks and extending between said end blocks; and a generally hollow cylindrical end block cover made of an insulating material and surrounding at least that part of any of said end blocks in which said conductive member is provided, said end block cover being slid on and along outer periphery of said end block in an axial direction of said end block cover into and out of engagement with said end block.

2. A device as claimed in claim 1, wherein the axial direction of said end block cover is parallel to a direction in which said corona wire extends.

3. A device as claimed in claim 1, wherein said conductive member comprises a spring member.

4. A device as claimed in claim 1, wherein said end block comprises a positioning member for positioning said corona wire, a tension member for applying tension to said corona wire, and a support member for supporting said end block.

5. A device as claimed in claim 4, wherein said end block cover comprises a tongue member covering said positioning member of said end block and a generally hollow cylindrical member surrounding said tension member.

* * * * *